US008636526B2

(12) United States Patent
Funamura et al.

(10) Patent No.: US 8,636,526 B2
(45) Date of Patent: Jan. 28, 2014

(54) CONNECTOR RECEPTACLES HAVING CONTACT PROTECTION DURING IMPROPER INSERTION OF A CARD

(75) Inventors: Joshua Funamura, San Jose, CA (US); Min Chul Kim, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/905,366

(22) Filed: Oct. 15, 2010

(65) Prior Publication Data

US 2012/0094513 A1 Apr. 19, 2012

(51) Int. Cl.
*H01R 13/44* (2006.01)

(52) U.S. Cl.
USPC ..... 439/137

(58) Field of Classification Search
USPC ..... 439/137, 142, 143, 260, 495, 264
See application file for complete search history.

(56) References Cited

U.S. PATENT DOCUMENTS

| | | | | | |
|---|---|---|---|---|---|
| 4,420,157 | A * | 12/1983 | White et al. | ..... | 273/272 |
| 4,480,884 | A * | 11/1984 | Babuka et al. | ..... | 439/59 |
| 4,717,349 | A * | 1/1988 | Johnson | ..... | 439/92 |
| 4,759,726 | A * | 7/1988 | Naylor et al. | ..... | 439/441 |
| 5,013,256 | A * | 5/1991 | Matsuoka et al. | ..... | 439/264 |
| 5,231,274 | A * | 7/1993 | Reynier et al. | ..... | 235/441 |
| 6,068,516 | A * | 5/2000 | Chang | ..... | 439/633 |
| 6,511,350 | B1 * | 1/2003 | Ito et al. | ..... | 439/680 |
| 6,663,403 | B2 * | 12/2003 | Hsu | ..... | 439/159 |
| 6,843,670 | B2 * | 1/2005 | Yamaguchi et al. | ..... | 439/159 |
| 6,851,959 | B2 * | 2/2005 | Ooya et al. | ..... | 439/159 |
| 6,929,491 | B1 * | 8/2005 | Chi-Te | ..... | 439/159 |
| 6,947,290 | B2 * | 9/2005 | Hirata | ..... | 361/741 |
| 7,114,968 | B2 * | 10/2006 | Healy | ..... | 439/137 |
| 7,275,963 | B2 * | 10/2007 | Kurita | ..... | 439/630 |
| 7,651,348 | B2 * | 1/2010 | Huang et al. | ..... | 439/137 |
| 7,794,281 | B2 * | 9/2010 | Matsumoto et al. | ..... | 439/630 |
| 2003/0092310 | A1 * | 5/2003 | Kunishi et al. | ..... | 439/495 |
| 2009/0068897 | A1 * | 3/2009 | Jin | ..... | 439/637 |
| 2009/0221184 | A1 * | 9/2009 | Matsumoto et al. | ..... | 439/629 |
| 2009/0298321 | A1 * | 12/2009 | Sakiyama et al. | ..... | 439/377 |

* cited by examiner

*Primary Examiner* — Chandrika Prasad
(74) *Attorney, Agent, or Firm* — Kilpatrick Townsend & Stockton LLP

(57) ABSTRACT

Circuits, methods, and apparatus that provide connector receptacles having a smaller size. One example provides this smaller size by decreasing the depth of the connector receptacle. Contacts in the connector receptacle may be protected from damage due to improper insertion of a second electronic device or connection to a second electronic device. This protection may be achieved in various ways. In some examples, one or more components or one or more contacts may be used to block the improper insertion of a second electronic device or connection to a second electronic device. In other examples, one or more contacts may avoid damage by being located outside of an insertion path until a second electronic device or connection to a second electronic device is inserted. In other examples, instead of blocking or avoiding an improper insertion, the contacts may avoid damage by bending out of the way.

16 Claims, 5 Drawing Sheets

CONNECTOR RECEPTACLES HAVING CONTACT PROTECTION DURING IMPROPER INSERTION OF A CARD

BACKGROUND

Portable and handheld devices have become ubiquitous the past several years. The proliferation of monitors, media players, portable media players, tablet, netbook, laptop, and all-in-one computers, cell phones, smart phones, and other devices has increased in an unabated manner that shows no signs of letting up.

These devices have become smaller and slimmer, and have been designed to include ever-increasing levels of functionality. The trend for the foreseeable future is to pack more features into increasingly smaller devices.

As a result, many parts of these devices, such as screens, controls, casings, power supplies, circuits, and other parts, have become smaller. It may be desirable to reduce the size of other components as well. For example, it may be desirable to reduce the size of connector receptacles.

Connector receptacles typically appear as a cavity, often on a side of an electronic device. These receptacle cavities may be arranged to receive a second electronic device or a connection to a second electronic device. For example, they may be arranged to receive a second electronic device, such as a memory device. These devices may include cards such as Secure Digital cards, Secure Digital High Capacity cards, Secure Digital Extended Capacity cards, memory sticks, compact flash, wireless transceiver, and other types of cards and modules. The receptacle cavity may also be arranged to receive a connector insert, which may be connected to a cable, a docking station, or other electronic component.

The connector receptacle may include a number of contacts to mate with contacts of a connector insert to form electrical or optical pathways. These electrical and optical pathways may include paths for power, data, status, control, or other types of signals.

Since these connector receptacles may form cavities along a side of an electronic device, they consume space in the electronic device. Since this space could otherwise be used to provide a smaller device or a device having increased functionality, it is desirable to reduce the size of these connector receptacles.

Thus, it is desirable to provide connector receptacles having a smaller size.

SUMMARY

Accordingly, embodiments of the present invention provide circuits, methods, and apparatus that may provide connector receptacles having a smaller size. An exemplary embodiment of the present invention may provide this smaller size by decreasing the depth of the connector receptacle. This exemplary embodiment of the present invention may protect contacts in the connector receptacle from damage due to the improperly angled insertion of a second electronic device or connection to a second electronic device.

In various embodiments of the present invention, this protection may be achieved in different ways. In some embodiments, one or more components may be used to block the improper insertion of a second electronic device or connection to a second electronic device. In a specific embodiment of the present invention, one or more blocking mechanisms or impediments may be used. These blocking mechanisms or impediments may present a flat surface to a second electronic device or connection to a second electronic device when the second electronic device or connection to the second electronic device is inserted at an improper angle. These blocking mechanisms may also bend out of the way when the second electronic device or connection to the second electronic device is inserted properly. In a specific embodiment of the present invention, spring fingers may be used as blocking mechanisms or impediments.

In other embodiments of the present invention, the contacts themselves may present a flat surface to a second electronic device or connection to a second electronic device when the second electronic device or connection to the second electronic device is inserted at an improper angle. The contacts may also move out of the way when the second electronic device or connection to the second electronic device is inserted properly.

In other embodiments of the present invention, the contacts may stay out of an insertion path until the second electronic device or connection to the second electronic device is inserted properly. In these embodiments, once the insertion is properly completed, the contacts may move into position and form electrical pathways.

In other embodiments of the present invention, instead of blocking an improper insertion, the contacts may avoid damage by bending out of the way. In a specific embodiment of the present invention, one or more contacts may be formed of a flexible material, such as a flexible wire or spring. When a second electronic device or connection to a second electronic device is improperly inserted, the contact may bend out of its path and remains undamaged. When the second electronic device or connection to the second electronic device is removed, the contact may spring back and be ready to receive a properly inserted second electronic device or connection to a second electronic device.

Various electronic devices may be improved by the incorporation of connector receptacles according to embodiments of the present invention. For example, computer monitors, media players, portable media players, tablets, netbooks, laptops, and all-in-one computers, cell phones, smart phones, and other devices may be improved by the incorporation of connector receptacles according to embodiments of the present invention.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
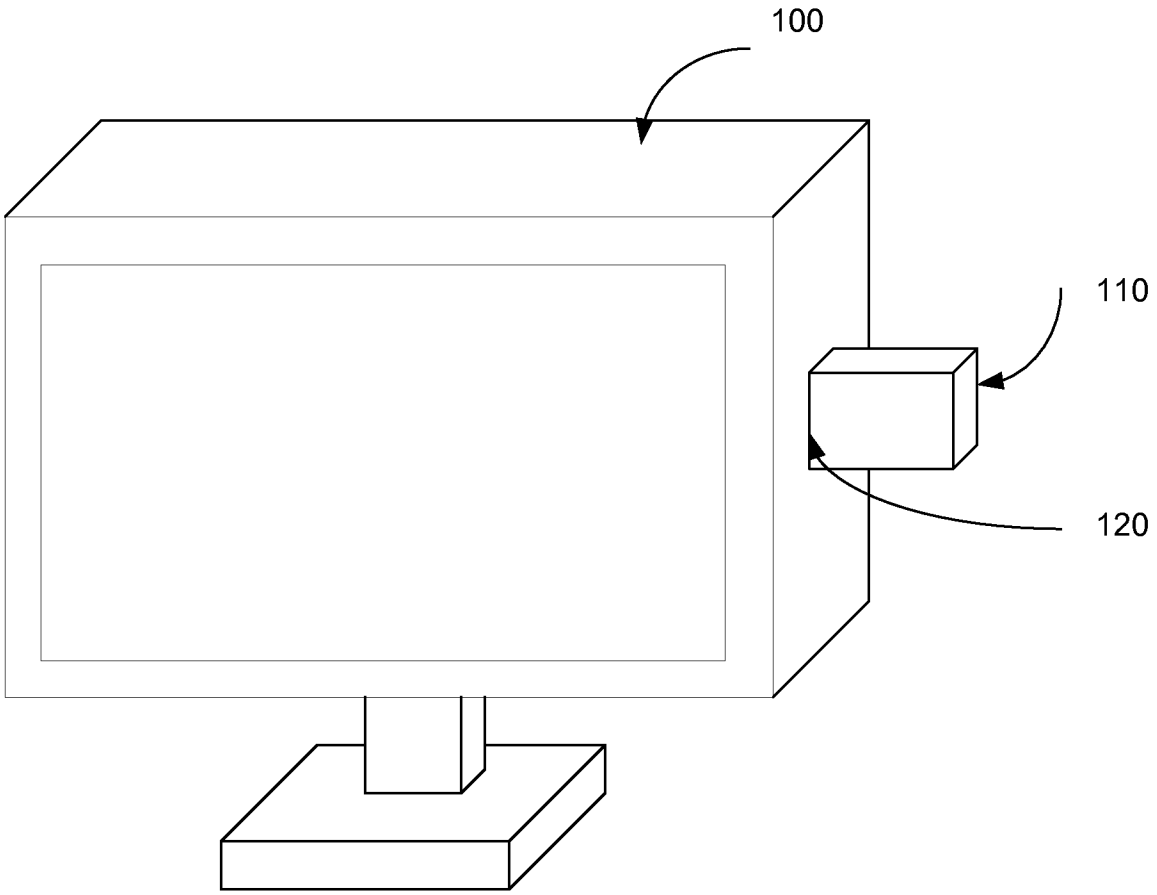
FIG. 1 illustrates an electronic device that is improved by the incorporation of embodiments of the present invention.

FIG. 1 illustrates an electronic device 100 that is improved by the incorporation of embodiments of the present invention. In this particular example, electronic device 100 may be a monitor or an all-in-one computer. Other types of electronic devices, such as media players, portable media players, tablets, netbooks, laptops, and all-in-one computers, cell phones, smart phones, and other types of devices may also be improved by the incorporation of embodiments of the present invention.

In this example, memory card 110 may be inserted into connector receptacle 120 located in the housing of electronic device 100. In a specific embodiment of the present invention, connector receptacle 120 may be arranged to receive a Secure Digital memory card 110. In other embodiments of the present invention, connector receptacle 120 may be configured to receive other types of memory cards or electronic devices, or connections to other electronic devices, such as a cable or docking station insert.

Again, it may be desirable to reduce the space consumed by connector receptacle 120. By shrinking the space consumed by connector receptacle 120, electronic device 100 may be made smaller or may include additional functionality.

In various embodiments of the present invention, the space consumed by connector receptacle 120 may be reduced by reducing its depth. But reducing the depth of connector receptacle 120 may lead to at least two potential vulnerabilities. The first is that when memory card 110 is inserted into a shallow-depth connector receptacle 120, more of the memory card 110 is exposed outside of the housing of electronic device 100. This leaves memory card 110 vulnerable to being inadvertently hit or struck by other equipment or users. This is particularly true in other types of electronic devices. However, where electronic device 100 is a display or all-in-one computer, memory card 110 is typically positioned such that it is less likely to be inadvertently hit or struck.

The second of the vulnerabilities is that a user may incorrectly insert memory card 110. For example, a user may incorrectly insert memory card 110 at an oblique angle relative to the connector receptacle 120. Because connector receptacle 120 is shallow, contacts in connector receptacle 120 may be relatively close to the surface of the housing of electronic device 100. When a user inserts memory card 110 improperly, a corner or edge of memory card 110 may strike one or more contacts at an angle, thereby possibly causing damage.

Accordingly, embodiments of the present invention may provide one or more features to protect contacts in a connector receptacle from an improper insertion of memory card 110, other device, or connection to other device. For example, various embodiments of the present invention may provide blocking mechanisms or impediments that protect contacts by blocking an improper insertion. Other embodiments of the present invention may provide contacts that act to block or impede an improper insertion. Other embodiments of the present invention may provide contacts that stay out of an insertion path until a memory card, other electronic device, or connection to another electronic device, is inserted. Still other embodiments of the present invention may provide contacts that are flexible and bend during an improper insertion, thereby remaining undamaged. Examples are shown in the following figures.

Figure 2:
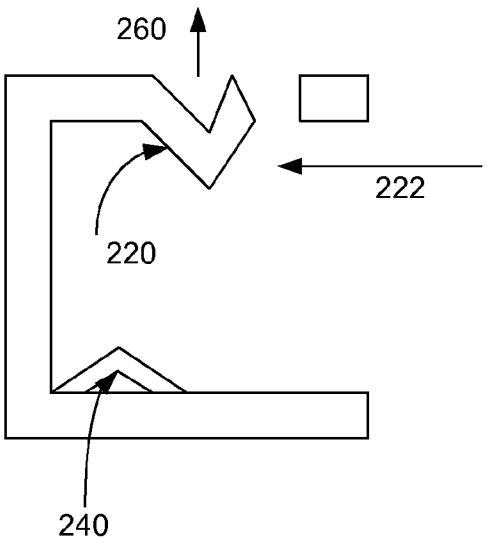
FIG. 2 illustrates a connector receptacle that includes a plurality of blocking mechanisms or impediments according to an embodiment of the present invention.
Figure 2:
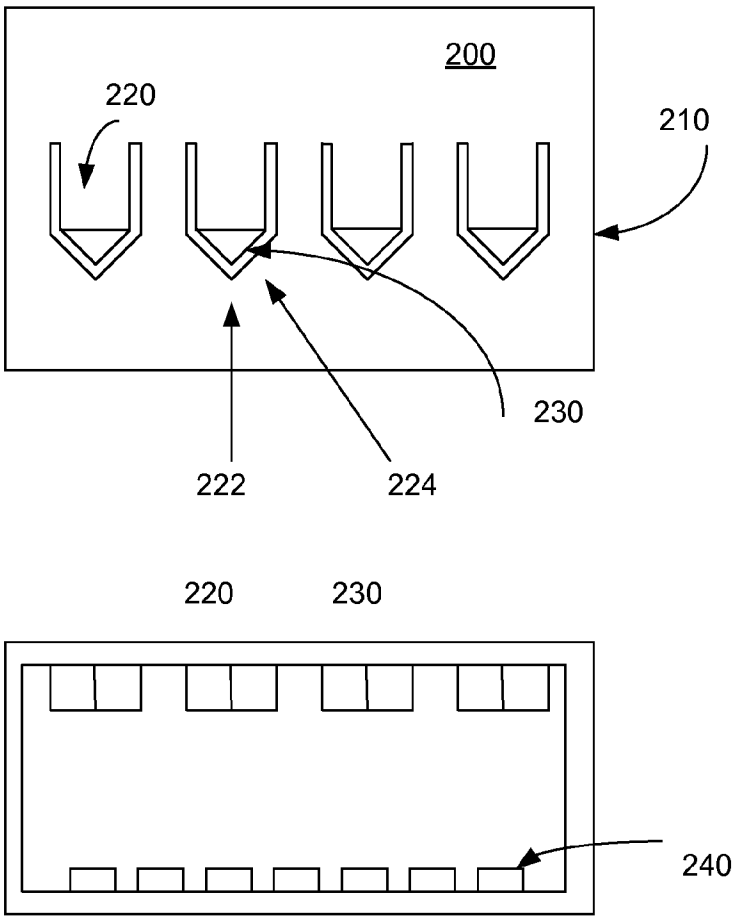

FIG. 2 illustrates a connector receptacle that includes a plurality of blocking mechanisms or impediments according to an embodiment of the present invention. Specifically, top, side cut-away, and front views of connector receptacle 200 are shown. This figure, as with the other included figures, is shown for illustrative purposes and does not limit either the possible embodiments of the present invention or the claims.

Connector receptacle 200 may include connector receptacle shell 210 having fingers 220. Fingers 220 may be stamped or attached to connector receptacle shell 210 or other portion of connector receptacle 200. In this specific example, fingers 220 are shown as being stamped in connector receptacle shell 210.

Again, fingers 220 may provide a blocking mechanism or impediments to an improper insertion. Accordingly, fingers 220 may include a point having faces 230. A face 230 may provide a relatively flat surface 230 that blocks improper insertions when a device or connector insert is inserted at an angle 224. This blocking may protect contacts 240 from experiencing oblique forces which may damage them. Fingers 220 may deflect upwards, allowing a proper insertion when a device or connector insert is inserted at angle 222.

Connector receptacle 200 may include other layers, such as a connector receptacle housing, which are not shown for simplicity. Connector receptacle shell 210 may be stainless steel, plastic, ceramic, or other material. Contacts 240 may be formed of a conductive material, such as stainless steel, plastic, ceramic, or other material. Also, while fingers 220 and contacts 240 are shown as being on opposite sides of connector receptacle 200, in some embodiments of the present invention, they may be on the same side.

Again, in some embodiments of the present invention, the contacts themselves may be arranged to block or impede an improper insertion. An example is shown in the following figure.

Figure 3:
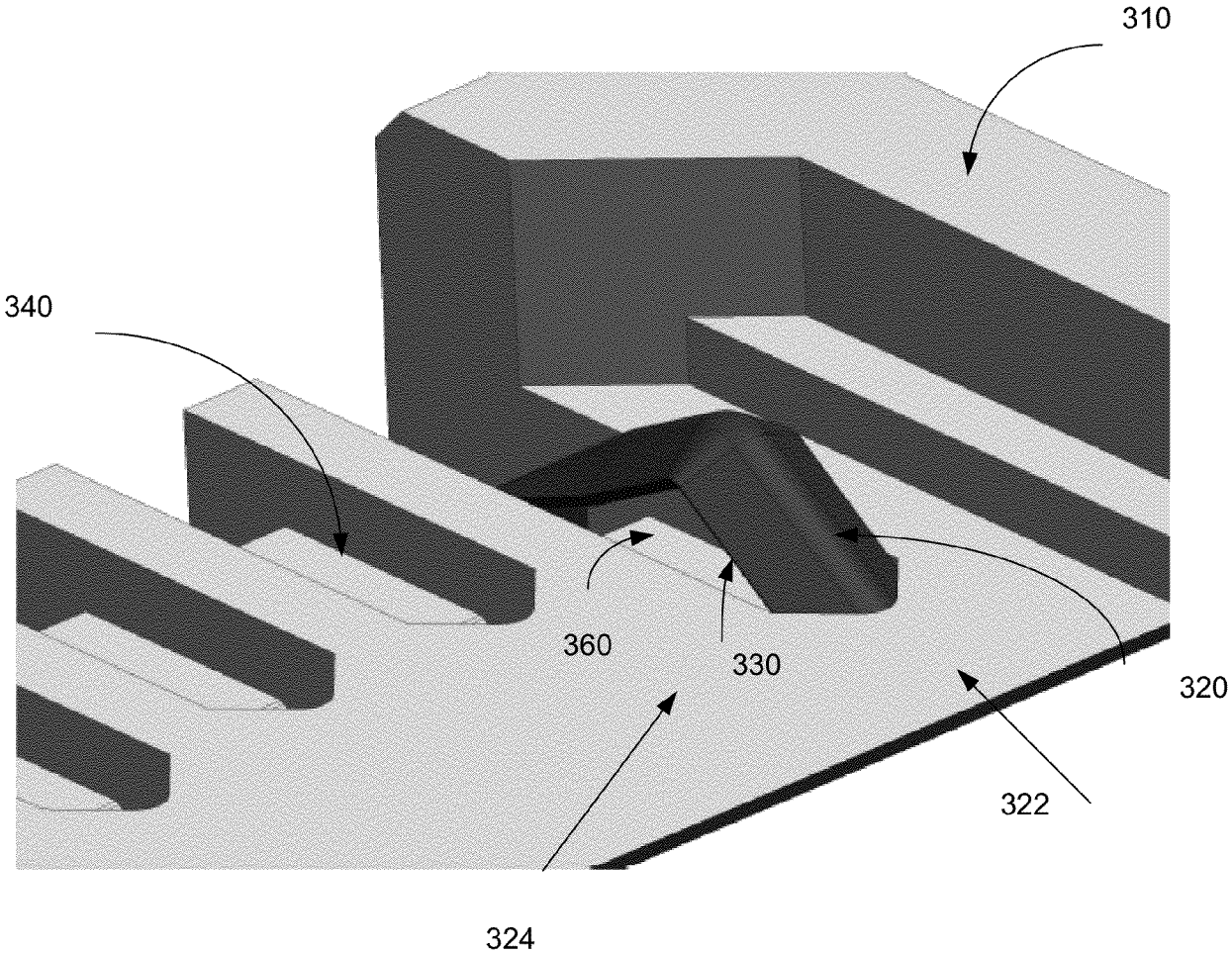
FIG. 3 illustrates a portion of a connector receptacle according to an embodiment of the present invention.

FIG. 3 illustrates a portion of a connector receptacle according to an embodiment of the present invention. This figure includes a portion of connector receptacle 310 and contact 320. Other contacts (not shown) may be located in connector receptacle 310, for example at position 340.

Contact 320 is arranged to deflect downwards when it experiences a force at an angle 322 during a proper insertion. But contact 320 provides an edge 330 that blocks an improper insertion of a second electronic device or a connection to a second electronic device at an angle 324. This arrangement, along with the reinforcement provided by grooved portion 360 in connector receptacle 310, may protect contacts 320 from damage during an improper insertion.

Again, various embodiments of the present invention may provide contacts that remain out of an insertion pathway until a memory or other electronic device or connector insert is properly inserted. An example is shown in the following figure.

Figure 4:
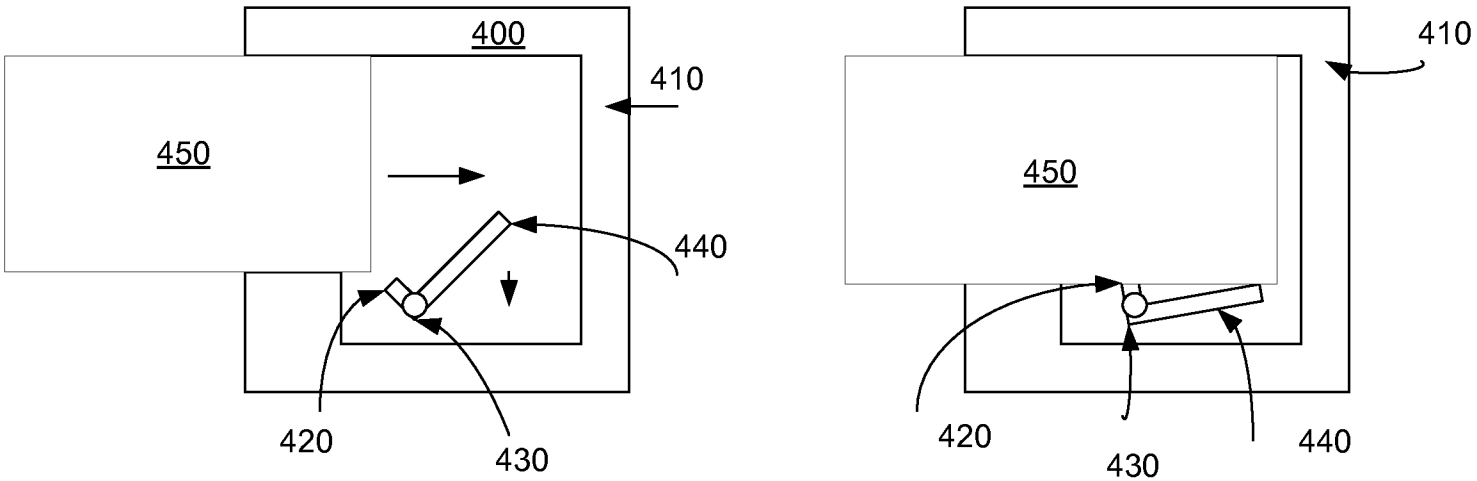
FIG. 4 illustrates a connector receptacle according to an embodiment of the present invention.

FIG. 4 illustrates a connector receptacle 400 according to an embodiment of the present invention. This figure includes connector receptacle 400 having a connector receptacle shell 410. As before, connector receptacle 400 may include other portions, such as a connector receptacle housing (not shown.)

In this example, contact 420 may remain out of a pathway of memory or electronic device or connector insert 450 as it is inserted into connector receptacle 400. Contact 420 may be attached to pivot point 430. Pivot point 430 may be attached to connector receptacle 400. A gate or lever 440 may also be attached to pivot point 430 and contact 420. As electronic device or connector insert 450 is inserted into connector receptacle 400, gate 440 is depressed, which lifts contact 420. When electronic device or connector insert 450 is inserted into connector receptacle 400, gate 440 remains depressed, and contact 420 forms an electronic connection with a corresponding contact (not shown) on electronic device or connector insert 450.

Again, in various embodiments of the present invention, one or more contacts may be flexible such that they bend during an improper insertion and are not damaged. An example is shown in the following figure.

Figure 5:
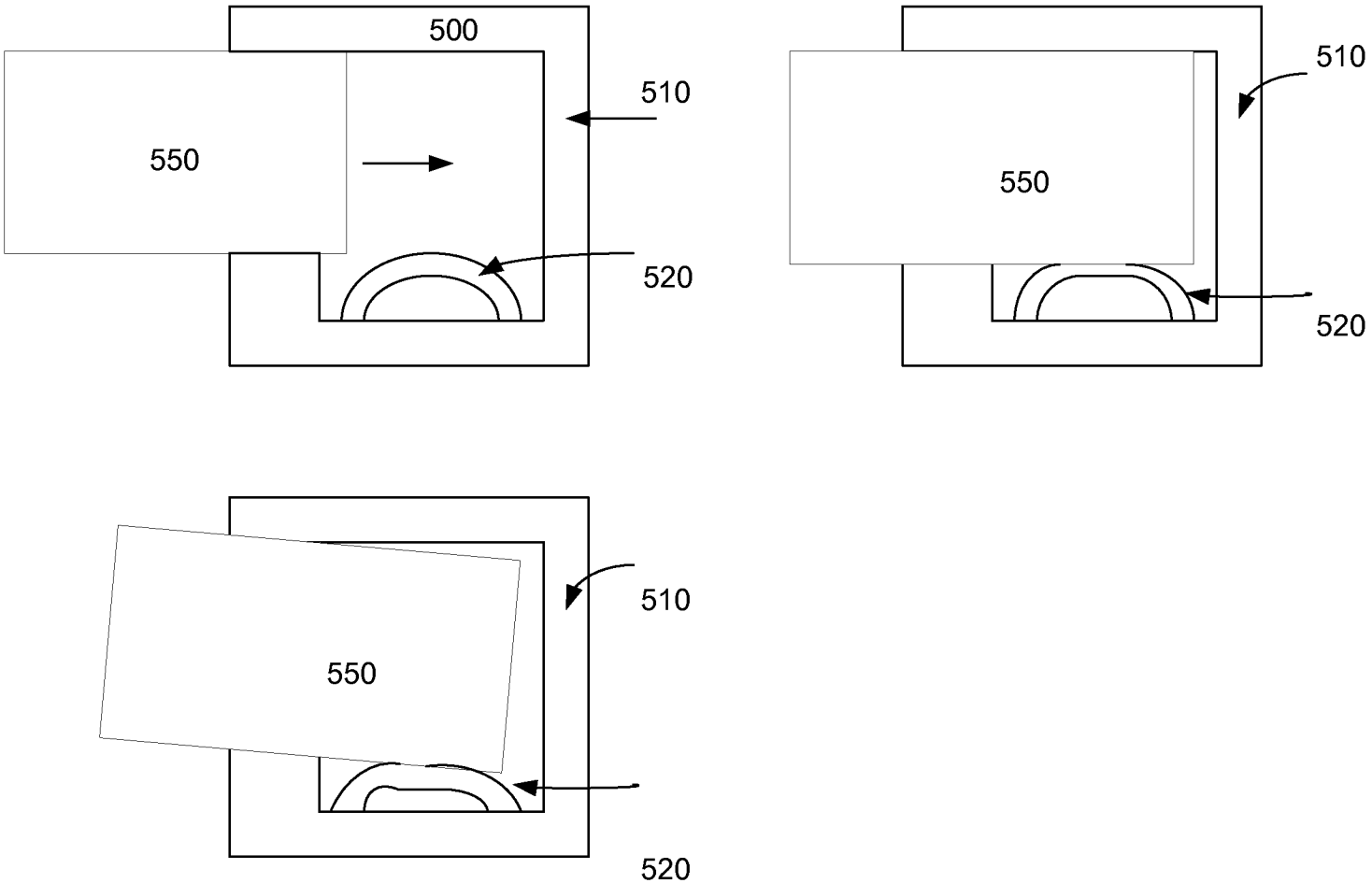
FIG. 5 illustrates a connector receptacle according to an embodiment of the present invention.

FIG. 5 illustrates a connector receptacle 500 according to an embodiment of the present invention. Connector receptacle 500 may include connector receptacle shell 510, as well as other portions (not shown.) Contact 520 may be flexible. For example, contact 520 may be made using wireform, spring wire, or other flexible material. As electronic device 550 or connector insert 550 is inserted into connector receptacle 500, contact 520 deflects. In this way, contacts 520 are not damaged during an improper insertion.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle comprising:

a shell around the connector receptacle;

a plurality of contacts; and a blocking mechanism to protect all contacts in the connector receptacle during an improper insertion of a card, wherein the blocking mechanism moves to allow a proper insertion of the card, wherein the blocking mechanism has a substantially flat edge at an oblique angle relative to an insertion path for the card to block the improper insertion of the card, and wherein the blocking mechanism is formed in a top of the shell and the contacts are located at a bottom of the connector receptacle.

2. The connector receptacle of claim 1 wherein the blocking mechanism deflects to allow proper insertion of the card.

3. The connector receptacle of claim 1 wherein the blocking mechanism protects the plurality of contacts during an improper insertion of a Secure Digital card.

4. The connector receptacle of claim 1 wherein the connector receptacle is arranged to receive a Secure Digital card.

5. The connector receptacle of claim 1 wherein the connector receptacle is arranged to receive a Secure Digital Extended Capacity card.

6. The connector receptacle of claim 1 wherein the connector receptacle is located in a monitor.

7. The connector receptacle of claim 1 wherein the connector receptacle is located in an all-in-one computer.

8. The connector receptacle of claim 1 wherein the plurality of contacts are contacts to convey data signals.

9. The connector receptacle of claim 1 wherein all contacts in the connector receptacle are contacts to convey data signals.

10. A connector receptacle comprising:

a plurality of contacts to convey data signals, wherein at least one of the plurality of contacts is flexible and deflects during an improper insertion of a card, and springs back into place when an improperly inserted card is removed.

11. The connector receptacle of claim 10 wherein at least one of the plurality of contacts is wire form.

12. The connector receptacle of claim 10 wherein the plurality of contacts are located on a bottom of the connector receptacle.

13. The connector receptacle of claim 10 wherein the connector receptacle is arranged to receive a Secure Digital card.

14. The connector receptacle of claim 10 wherein the connector receptacle is arranged to receive a Secure Digital Extended Capacity card.

15. The connector receptacle of claim 10 wherein the connector receptacle is located in a monitor.

16. The connector receptacle of claim 10 wherein the connector receptacle is located in an all-in-one computer.

* * * * *